United States Patent [19]

Nakayama

[11] 4,085,176

[45] Apr. 18, 1978

[54] METHOD OF MANUFACTURING NON-SLIP PAVEMENT BLOCKS

[75] Inventor: Fukuzo Nakayama, Hyogo, Japan

[73] Assignee: Japan Non-Slip Pavement Co., Inc., Japan

[21] Appl. No.: 448,032

[22] Filed: Mar. 4, 1974

Related U.S. Application Data

[62] Division of Ser. No. 281,767, Aug. 18, 1972, Pat. No. 3,832,078.

[51] Int. Cl.[2] ..... B28B 1/16; B28B 3/00

[52] U.S. Cl. ..... 264/82; 264/247; 264/256; 264/273; 264/277; 264/278; 264/333; 264/336; 264/DIG. 43

[58] Field of Search ..... 264/247, 278, 261, 273, 264/277, 256, 333, 82, 336, DIG. 43

[56] References Cited

U.S. PATENT DOCUMENTS

| | | | |
|---|---|---|---|
| 1,539,148 | 5/1925 | Sylvester | 264/247 X |
| 2,163,814 | 6/1939 | Swarorski | 264/277 X |
| 2,651,079 | 9/1953 | Michaelson | 264/247 X |
| 3,000,237 | 9/1961 | Phillips | 264/219 X |

*Primary Examiner*—Thomas P. Pavelko
*Attorney, Agent, or Firm*—Armstrong, Nikaido, Marmelstein & Kubovcik

[57] ABSTRACT

This invention relates to a method and apparatus for manufacturing pavement blocks and the product resulting therefrom in which said blocks have rubber tips projecting from the surfaces thereof, and includes inserting a perforated plate and introducing projection elements into the perforation and against the base plate, thereafter introducing filler material, compressing the ingredients, removing the compressed unit from, including the base, the frame and thereafter removing the base plate and perforated plate.

4 Claims, 6 Drawing Figures

METHOD OF MANUFACTURING NON-SLIP PAVEMENT BLOCKS

This is a division of application Ser. No. 281,767, filed Aug. 18, 1972, now U.S. Pat. No. 3,832,078.

BACKGROUND OF THE INVENTION

The present invention pertains to a method and apparatus for producing pavement blocks and the product resulting therefrom, wherein the blocks have rubber projections protruding from the surfaces thereof. Particularly, the present invention relates to the production of a compact, strong and rigid block in which the rubber tip projections are located so as to be anchored securely for high resistance and longevity of wear. Moreover, the present method permits the production of such blocks with ease and rapidity at a reasonable commercial expense due to the use of inexpensive ingredients and apparatus components.

The primary object of the present invention is, therefore, to provide a method and apparatus for producing non-slip pavement blocks in a simple, inexpensive and rapid manner and to provide a rigid, high resistance block of long wear which will be useful for pedestrian or other travel and will prevent accidental falls and the injury or damage resulting therefrom.

Another object of my invention is to provide a method and apparatus for the producing of a non-slip pavement block which is an improvement over past pavement blocks with plain surfaces in that it provides a surface against which objects such as the sole of a shoe will not slip, but will instead grip.

A still further object of my invention is to provide a non-slip pavement block composed of concrete or similar material with rubber tip projections protruding from the surface thereof and which is capable of use in a variety of settings including, but not limited to, business pavements, residential pavements, and park pavements, and the like.

Yet another object of my invention is to provide a method, apparatus and product of the classes indicated that are capable of the functions and uses referred to and which are based upon sound engineering and construction principles to result in a non-slip pavement block of high quality and strength which will inhibit and prevent slippage and falling by pedestrian and other travel.

Other objects will appear hereinafter.

SUMMARY OF THE INVENTION

In general, carrying out the present invention includes providing a plate of predetermined thickness with perforations of the same shape as the rubber tip to be engaged therein and said perforations are distributed to coincide with the distribution of rubber tips. This plate is prepared and placed on a base plate or member which is surrounded by a molding frame. A wire net containing the rubber tips is placed on the perforated plate, with each rubber tip directed into the corresponding perforations in the perforated plate and against the base plate. The rubber tips are located at the intersectional points of the wire forming the net. A concrete mixture, or the like, is poured over the wire net and onto the perforated plate to surround the rubber tips. Onto this concrete, or similar material, another filling material is poured, and this is pressed to made the unit sufficiently compact and hard to withstand substantial pressure. The combined ingredients form the concrete block unit.

The concrete block along with the base plate is removed from the molding frame.

The non-slip pavement block of the present invention is finally completed with the base-plate is removed from the filling material and other ingredients and elements of the unit.

DETAILED DESCRIPTION OF THE DRAWINGS

Figure 6:
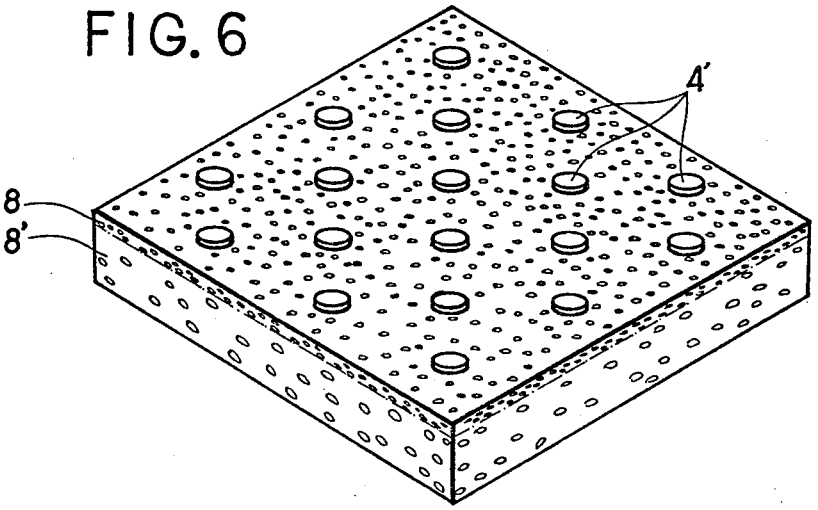
FIG. 6 is a perspective view of non-slip pavement block obtained as a result of the process steps of this invention.

To manufacture non-slip pavement blocks as shown in FIG. 6, a perforated plate 1 which is square shaped and made from vinyl chloride, FRP, etc. is prepared. On the plate 1, perforations are made and properly shaped to coincide with non-slip tips which are to be provided. These perforations are distributed on the plate in a predetermined pattern or arrangement.

The thickness of the perforated plate is, for example, 1–2mm. The thickness is predetermined in relation to the rubber tip thickness to permit these non-slip tips made from rubber, or other material to project from the surface of the final block. The perforations 2 may have any shape desired, such as slot, circle, diamond, cross or star, etc. to correspond to the cross-sectional shape of non-slip tips made from rubber, or other elastomer.

Figure 1:
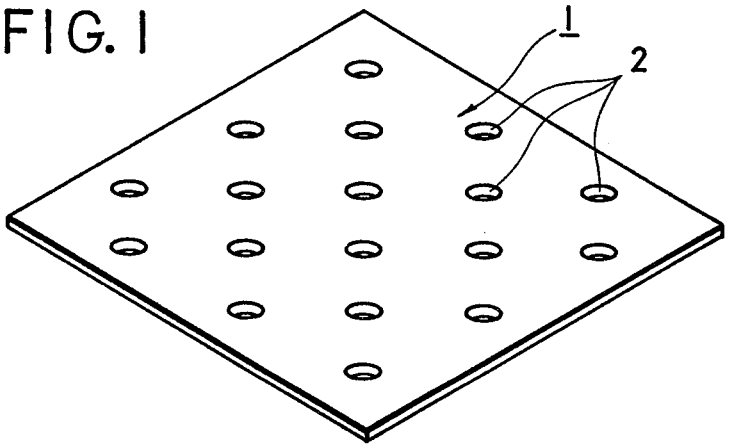
FIG. 1 is a perspective view of the perforated plate.
Figure 2:
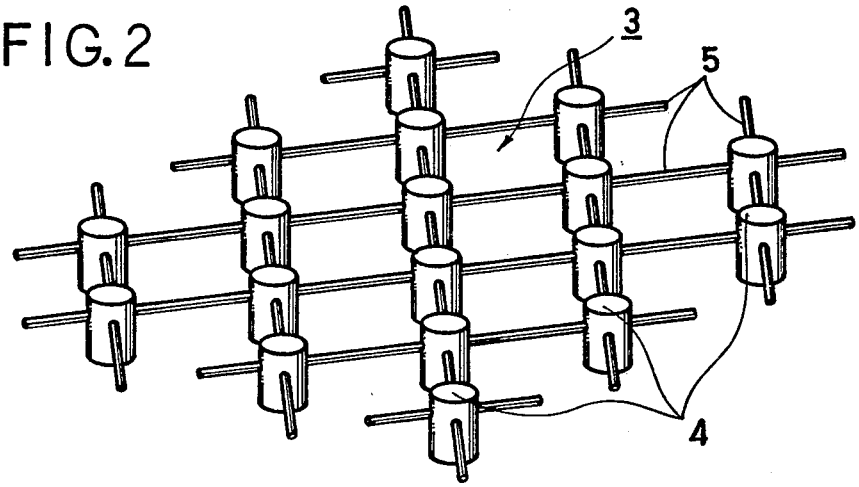
FIG. 2 is a perspective view of the wire net containing the rubber tips.

The perforations 2 for the insertion of non-slip tips are so distributed as to coincide with the location of each of the non-slip tips fixed in the net shown in FIG.2.

A net 3 in FIG. 2 has the same shape with a slightly smaller area than the perforated plate. The net consists of rigid, straight wires crossing perpendicularly or diagonally to make a net formation, and at the intersectional points, the rigid wires pierce the body portion of non-slip tips of which the cross-sectional figure is in the shape of a rod, belt, circle, cross, diamond, star, etc.

The distribution of non-slip tips in the net 3 naturally corresponds to the distribution of perforations 2 in the perforated plate 1.

Figure 3:
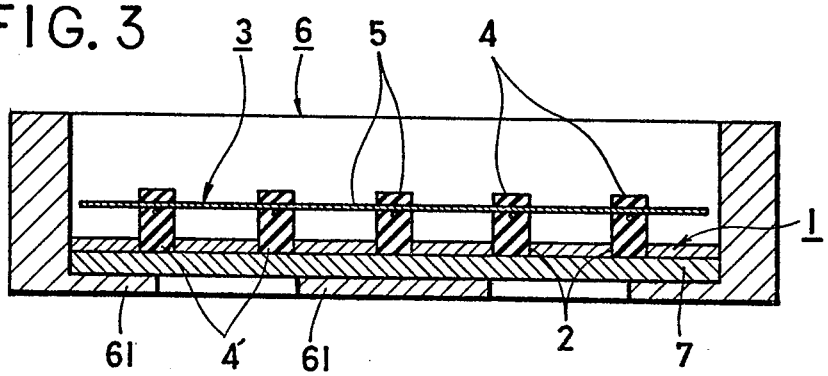
FIGS. 3 to 5 illustrate the stages in manufacturing the pavement block.
Figure 4:
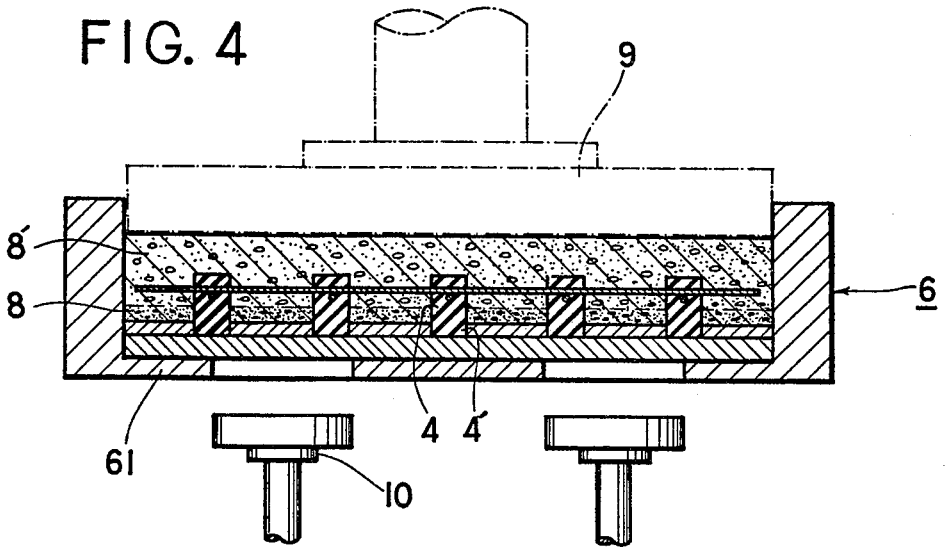

Molding frame 6 shown in FIGS. 3 and 4 is in the form of a short cylinder having support 61 at the bottom. The inside dimensions and shape of frame 6 corresponds to the shape of the final pavement block and the frame 6 is deeper than the thickness of block.

In carrying out the process for producing the non-slip pavement blocks, a base plate 7 is put on the support 61 in molding frame 6 as shown in FIGS. 3 and 4.

On the base plate 7, a perforated plate 1 is laid down and a net 3 is put into the frame with the head 4' of tips 4 upside down. Head 4' of each non-slip tip 4 is inserted into the hole 2 of perforated plate 1 as shown in FIG. 3.

Into the molding frame 6, soft filling material 8 is poured to surround the rows of non-slip tips 4 to a thickness of approximately 10mm. The filling material 8 is to be a proper material to conform to the uses of pavement blocks, such as a paste of concrete and mortar mixture, or a paste of coloured mortar which is a mixture of white cement and pigment, or a paste of terazo which is a mixture of white cement and pigment containing crushed marble or rock, or plastics liquid such as polyester added to hardening material containing crushed terazo or granite.

Onto the softened filling material 8, a slightly hard concrete paste 8' is poured to a predetermined thickness so as to permit water contained in the softened filling material 8 to soak out into the hard concrete paste 8'.

After eliminating bubbles and air pockets contained in filling materials 8 and 8' by vibrating the frame 6, a pressure of 7–10 atm is exerted against the surface of the hard concrete paste 8' by means of a press 9 until the materials 8 and 8' solidify and become rigid and hard.

When the press 9 is removed, the molded filling material 8 and 8' and the other ingredients of the unit are pushed out along with base plate 7 from molding frame 6 by pressing the back of base plate 7 with push-rod 10 through the spaces between support members 61.

The unit pushed out from molding frame 6 is conveyed into a steam room and kept there for a predetermined period.

Figure 5:
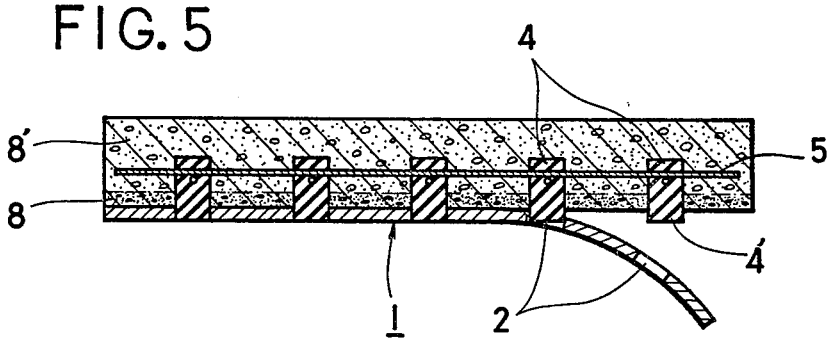

After treatment with steam, perforated plate 1 is removed from the concrete as shown in FIG. 5. By keeping the concrete body in water for one or two days, and then drying it in the air, a complete pavement block is obtained.

In this invention, the height of tip heads 4' projecting from the surface of block is modified by adjusting and varying the thickness of perforated plate 1. As all projections of tips 4 can be easily made equal by the perforated plate 1 in combination with base plate 7, non-slip pavement blocks can be reproduced in a rapid and easy fashion.

From the foregoing, it may be seen that I have provided a useful method and apparatus for formation of non-slip pavement blocks and a useful and valuable product resulting from that method and apparatus in the form of a block composed of concrete or similar material with rubber tip projections protruding from the surface thereof and which is useful in various business, private and public environments for inhibiting and preventing damage and injury resulting from slippage and falling. The method and apparatus are simple, inexpensive and rapid and the product is of high quality, strength and resistance.

The present invention may be embodied in other specific forms without departing from the spirit or essential characteristics thereof. The pesently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method for producing non-slip pavement blocks, comprising:

(a) providing a plate of predetermined thickness containing a plurality of perforations therein;

(b) placing the perforated plate on a base plate of a mold comprised of side frame elements forming an enclosure with one end thereof covered by said base plate;

(c) inserting projection elements in the perforations and against the base plate such that said elements extend above the surface of said perforated plate, said projection elements being disposed on a wire net in a pattern corresponding to the perforations in the plate;

(d) introducing a mixture capable of solidificaton through the open end of said mold frame over, around and covering the exposed portions of the projections and the perforated plate;

(e) compressing the ingredients in the mold against the base plate, and allowing solidification;

(f) removing from the mold frame the compacted solidified ingredients as a unit along with the base plate;

(g) removing the base plate and stripping the perforated plate from the solidified ingredients by peeling it away.

2. A method for producing non-slip pavement blocks, comprising:

(a) providing a plate of predetermined thickness containing a plurality of perforations therein, with said perforations disposed in a predetermined pattern;

(b) placing the perforated plate on a base plate of a mold comprises of side frame elements forming an enclosure with one end thereof covered by said base plate;

(c) inserting projection elements in the perforations and against the base plate such that said elements extend above the surface of said perforated plate, said projection elements being disposed on a wire net in a pattern corresponding to the perforations in the plate;

(d) introducing a hydraulically settable mixture capable of solidifiction through the open end of said mold frame over, around and covering the projections and the perforated plate;

(e) compressing the ingredients in the mold against the base plate, and allowing solidification;

(f) removing from the mold frame the compacted solidified ingredients as a unit along with the base plate;

(g) subjecting the unit to steam treatment for a predetermined time;

(h) removing the base plate and stripping the perforated plate.

3. A method for producing non-slip pavement blocks, comprising:

(a) providing a plate of predetermined thickness containing a plurality of perforations therein, with said perforations disposed in a predetermined pattern;

(b) placing the perforated plate on a base plate of a mold comprised of side frame elements forming an enclosure with one end thereof covered by said base plate;

(c) inserting projection elements in the perforations and against the base plate such that said elements extend above the surface of said perforated plate and wherein said projection elements are disposed on a wire net in a pattern corresponding to the perforations in the plate;

(d) introducing a first hydraulically settable mixture capable of solidifcation through the open end of said mold frame over, around and covering the projections and the perforated plate;

(e) introducing a second hydraulically settable mixture capable of solidification through the open end of said mold frame and on top of said first mixture;

(f) compressing the ingredients in the mold against the base plate, and allowing solidification;

(g) removing from the mold frame the compacted solidified ingredients as a unit along with the base plate;

(h) subjecting the unit to steam treatment for a predetermined time;

(i) removing the base plate and perforated plate;

(j) soaking the block in water and drying it in air.

4. A method for producing non-slip pavement blocks according to claim 3, wherein the projection elements are rubber projectiles, the first mixture is a paste of concrete or mortar or terrazzo, and the second mixture is a concrete paste and removal of the unit and base plate is accomplished by pressure exerted against the base plate from outside the mold frame.

* * * * *